US007350894B2

(12) United States Patent
Takeuchi

(10) Patent No.: US 7,350,894 B2
(45) Date of Patent: Apr. 1, 2008

(54) INK JET PRINTER

(75) Inventor: Hiroshi Takeuchi, Tokyo (JP)

(73) Assignee: Konica Minolta Holdings, Inc., Tokyo (JP)

( * ) Notice: Subject to any disclaimer, the term of this patent is extended or adjusted under 35 U.S.C. 154(b) by 287 days.

(21) Appl. No.: 11/022,194

(22) Filed: Dec. 23, 2004

(65) Prior Publication Data

US 2005/0151770 A1 Jul. 14, 2005

(30) Foreign Application Priority Data

Jan. 13, 2004 (JP) ..... 2004-005189
Jan. 13, 2004 (JP) ..... 2004-005190

(51) Int. Cl.
*B41J 29/38* (2006.01)

(52) U.S. Cl. ..... 347/16; 347/9; 347/19

(58) Field of Classification Search ..... 347/16, 347/19, 9, 5, 10

See application file for complete search history.

(56) References Cited

U.S. PATENT DOCUMENTS 6,497,468 B1 * 12/2002 Otsuka ..... 347/16

FOREIGN PATENT DOCUMENTS

JP 2003-200563 A 7/2003

* cited by examiner

*Primary Examiner*—Lam S. Nguyen
(74) *Attorney, Agent, or Firm*—Frishauf, Holtz, Goodman & Chick, P.C.

(57) ABSTRACT

An ink jet printer including a print head having nozzles for jetting ink for a length corresponding to dimensions of a recording medium in the direction perpendicular to the conveyance direction, a recording medium conveying section, a print head driving section that makes the print head to jet ink synchronizing with conveyance of the recording medium, a speed setting section to set printing speed based on the instruction of a user, and a control section that determines conveyance speed of the recording medium based on the printing speed established by the speed setting section, and determines a time interval from the completion of printing of one page to the start of printing for the next page, and makes the conveying section to convey and supply the recording medium at the determined conveyance speed and time interval.

25 Claims, 6 Drawing Sheets

FIG. 6

| PRINTING SPEED | CONVEYANCE SPEED | TIME INTERVAL |
|---|---|---|
| 194 pages/min. | 1000 mm/sec. | 0.1 sec. |
| 178→194 pages/min. | 885→1000 mm/sec. | 0.1 sec. |
| 161→178 pages/min. | un-settable | un-settable |
| 0→161 pages/min. | 0→770 mm/sec. | 0.1 sec. |

FIG. 7

| PRINTING SPEED | CONVEYANCE SPEED | TIME INTERVAL |
|---|---|---|
| 194 pages/min. | 1000 mm/sec. | 0.1 sec. |
| 178→194 pages/min. | 885→1000 mm/sec. | 0.1 sec. |
| 161→178 pages/min. | 885 mm/sec. | 0.135 sec→0.1 sec. |
| 161 pages/min. | 770 mm/sec. | 0.1 sec. |
| 0→161 pages/min. | 0→770 mm/sec. | 0.1 sec. |

INK JET PRINTER

BACKGROUND OF THE INVENTION

The present invention relates to an ink jet printer, and in particular, to an ink jet printer employing a longer stationary print head.

As a sort of an ink jet printer, there is known a printer that uses a longer print head. In the printer of this kind, the print head is a stationary head having a length corresponding to the total width of a recording medium, and a document and others are printed by an ink jet on a recording medium that faces the print head and is conveyed in the direction perpendicular to the longitudinal direction of the print head (for example, see Patent Document 1).

The ink jet printer of this kind that prints immediately for the total width of a recording medium by a longer print head can print much faster than the so-called shuttle type printer that prints while sweeping a movable print head along a recording medium.

(Patent Document 1) TOKKAI No. 2003-200563 (page 3, FIGS. 1-2)

Because of a high speed, the printer stated above is suitable for a task to conduct printing a document and others in a relatively large volume. When a printer is used for a printing task, a speedup of the printing speed is required for improvement of efficiency.

Though a speedup of the conveyance speed for a recording medium and conversion to the higher frequency for print head driving that follows the foregoing speedup of the conveyance speed are needed for a speedup of the printing speed, if the frequency for driving the print head is raised, the dispersion of an amount of liquid-drop of ink to be jetted, an angle of fly and of a flying speed grows greater, which increases an error of an impact position of an ink drop and lower a quality, together with a speedup of the conveyance speed for a recording medium. Further, troubles such as quality lowering resulting from changes in physical properties of ink caused by temperature rise in the print head and problems of an ink overflow and contamination on a recording medium caused by problematic fixing and drying of ink.

To use the ink jet printer having such characteristics conveniently as a printer for business use, it is necessary to work out to enhance productivity of printing as high as possible, taking that characteristics into account. Now, an object of the invention is to realize an ink jet printer wherein the trade-off between the printing speed and the print quality is achieved under the condition of satisfactory productivity.

SUMMARY OF THE INVENTION

Inventions as means to solve the foregoing problems are as follows.

Structure 1

The invention described in Structure 1 is an ink jet printer having therein a print head having plural nozzles for jetting ink for a length corresponding to the dimension of a recording medium in the direction perpendicular to the conveyance direction, a medium conveying means that conducts supply of a recording medium to the print head and conducts conveyance of a recording medium under the print head, a head driving means that makes the print head to conduct ink jetting that is synchronized with conveyance of a recording medium, a speed setting means to set the stepless printing speed based on the user's instruction, a control means that determines a conveyance speed for a recording medium under the print head based on the printing speed established by the speed setting means, and determines the conveyance speed of the recording medium excluding the predetermined speed, and makes the medium conveying means to conduct conveyance of the recording medium at the determined conveyance speed.

Structure 2

The invention described in Structure 2 is the ink jet printer according to Structure 1, wherein the predetermined speed is a speed corresponding to a frequency that is unable to drive the print head stably.

Structure 3

The invention described in Structure 3 is the ink jet printer according to Structure 1, wherein the predetermined speed is a speed that is unable to convey a recording medium stably.

Structure 4

The invention described in Structure 4 is the ink jet printer according to any one of Structures 1-3, wherein the control means restricts the maximum value of the conveyance speed based on at least one of characteristic values of a document to be printed, a type of a recording medium, ambient temperature and a temperature of a print head, and indicates or restrict the maximum value of the printing speed that can be set by a user.

Structure 5

The invention described in Structure 5 is the ink jet printer according to Structure 4, wherein the characteristic value is the number of times of ink jetting required for printing of a document.

Structure 6

The invention described in Structure 6 is the ink jet printer according to Structure 4, wherein the characteristic value is the maximum value of an amount of ink jetting per unit area required for printing of a document.

Structure 7

The invention described in Structure 7 is the ink jet printer according to any one of Structures 1-6, wherein, when the speed established by the speed setting means is changed in the course of printing, the new conveyance speed corresponding to that speed is applied to the next page and thereafter.

Structure 8

The invention described in Structure 8 is the ink jet printer according to any one of Structures 1-7, wherein the control means monitors a temperature of the print head, and sends out a warning when the temperature change exceeds the limit determined in advance.

Structure 9

The invention described in Structure 9 is the ink jet printer according to any one of Structures 1-7, wherein the control means monitors a temperature of the print head, and stops printing when the temperature exceeds the limit determined in advance.

Structure 10

The invention described in Structure 10 is the ink jet printer according to any one of Structures 1-9, wherein the head driving means drives the print head with driving signals having a wave form corresponding to the conveyance speed.

Structure 11

The invention described in Structure 11 is an ink jet printer having therein a print head having plural nozzles for jetting ink for a length corresponding to the dimension of a recording medium in the direction perpendicular to the conveyance direction, a medium conveying means that conducts supply of a recording medium to the print head and conducts conveyance of a recording medium under the print head, a head driving means that makes the print head to conduct ink jetting that is synchronized with conveyance of a recording medium, a speed setting means to set the printing speed based on the user's instruction, and a control means that determines a conveyance speed for a recording medium under the print head based on the printing speed established by the speed setting means, and determines a time interval from the completion of printing of one page to the start of printing for the next page, and makes the medium conveying means to conduct conveyance and supply of a recording medium under the conditions of the conveyance speed and the time interval.

Structure 12

The invention described in Structure 12 is the ink jet printer according to Structure 11, wherein the printing speed established by the speed setting means is a combination of the conveyance speed and the time interval.

Structure 13

The invention described in Structure 13 is the ink jet printer according to Structure 11, wherein the printing speed established by the speed setting means represents an amount of prints per unit time.

Structure 14

The invention described in Structure 14 is the ink jet printer according to any one of Structures 11-13, wherein the conveyance speed to be determined by the control means is a speed excluding the speed determined in advance.

Structure 15

The invention described in Structure 15 is the ink jet printer according to Structure 14, wherein the predetermined speed is a speed corresponding to a frequency that is unable to drive the print head stably.

Structure 16

The invention described in Structure 16 is the ink jet printer according to Structure 14, wherein the speed determined in advance is a speed that is unable to convey a recording medium stably.

Structure 17

The invention described in Structure 17 is the ink jet printer according to any one of Structures 11-16, wherein the control means restricts the maximum value of the conveyance speed and the minimum value of the time interval based on at least one of characteristic values of a document to be printed, a type of a recording medium, ambient temperature and a temperature of a print head, and indicates or restrict the maximum value of the printing speed that can be set by a user.

Structure 18

The invention described in Structure 18 is the ink jet printer according to Structure 17, wherein the characteristic value is the number of times of ink jetting required for printing of a document.

Structure 19

The invention described in Structure 19 is the ink jet printer according to Structure 17, wherein the characteristic value is the maximum value of an amount of ink jetting per unit area required for printing of a document.

Structure 20

The invention described in Structure 20 is the ink jet printer according to any one of Structures 11-19, wherein, when the speed established by the speed setting means is changed in the course of printing, the new conveyance speed corresponding to that speed is applied to the next page and thereafter.

Structure 21

The invention described in Structure 21 is the ink jet printer according to any one of Structures 11-20, wherein the control means monitors a temperature of the print head, and sends out a warning when the temperature change exceeds the limit determined in advance.

Structure 22

The invention described in Structure 22 is the ink jet printer according to any one of Structures 11-20, wherein the control means monitors a temperature of the print head, and stops printing when the temperature exceeds the limit determined in advance.

Structure 23

The invention described in Structure 23 is the ink jet printer according to any one of Structures 11-22, wherein the head driving means-drives the print head with driving signals having a wave form corresponding to the conveyance speed.

Structure 24

The invention described in Structure 24 is the ink jet printer according to any one of Structures 11-23, wherein the printing speeds which can be established by the speed setting means are infinitely variable.

BRIEF DESCRIPTION OF THE DRAWINGS

FIG. 6 is a diagram showing an example of correspondence for printing speeds, conveyance speeds and time intervals.

FIG. 7 is a diagram showing an example of correspondence for printing speeds, conveyance speeds and time intervals.

DETAILED DESCRIPTION OF THE PREFERRED EMBODIENT

Figure 1:
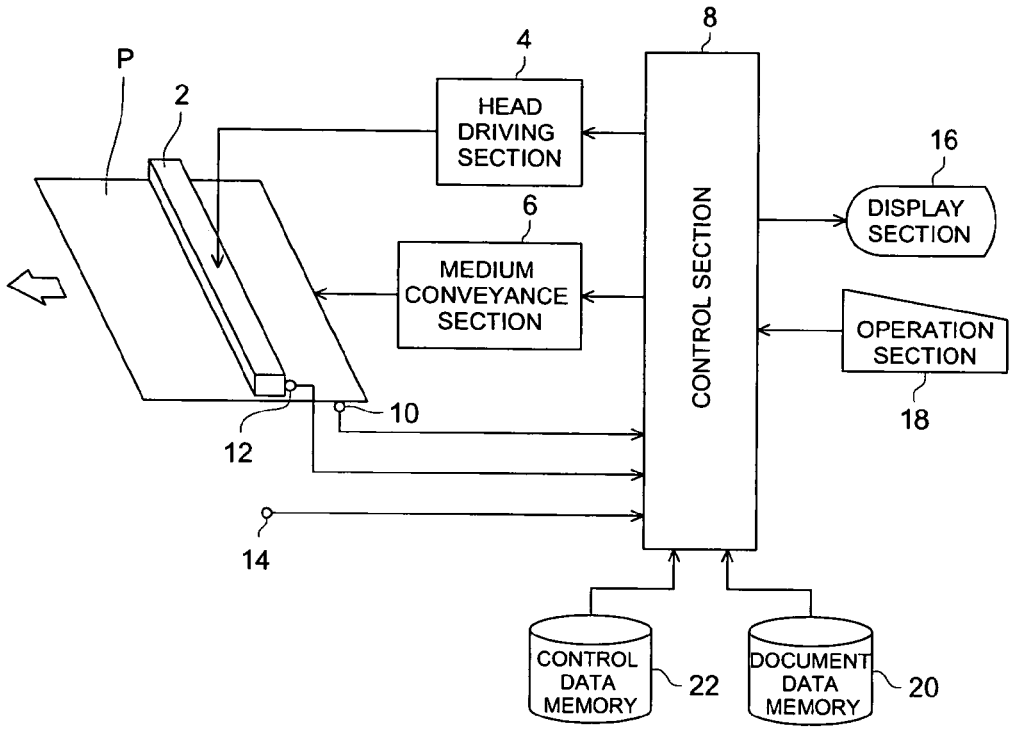
FIG. 1 is a block diagram of an ink jet printer.

Preferred embodiments to practice the invention will be explained in detail as follows, referring to the drawings. Incidentally, the invention is not limited to the preferred embodiments to practice the invention. FIG. 1 shows a block diagram of the ink jet printer. The present apparatus is an example of the preferred embodiment to practice the invention. The structure of the present apparatus shows an example of the preferred embodiment for practicing the invention relating to the ink jet printer.

As shown in the diagram, the present apparatus has therein print head 2 which conducts printing on recording medium P through an ink jet mode. Ink is supplied from an ink tank that is not illustrated.

The print head 2 is a print head of a longer type, and when recording medium P is in an A4 size, for example, the print head has a length (297 mm) that fits to the long side of the A4 size. The print head 2 is fixed in terms of its position. Under the print head 2, the recording medium P is conveyed in the direction perpendicular to the longitudinal direction of the print head, namely, in the lateral direction of the recording medium P, as shown with an arrow. Incidentally, it is also possible to employ the structure wherein a length of the print head 2 fits to the length of the short side of the recording medium P, and the recording medium P is conveyed in its longitudinal direction.

The print head 2 has, on its surface facing the recording medium P, many ink-jetting nozzles, and conducts printing by jetting ink from these nozzles. For example, when assuming that printing with dot density of 600 dots/25.4 mm is conducted, the print head 2 has 7016 nozzles in its longitudinal direction. Owing to these nozzles, 4961 dots in total are printed in a range of a length (210 mm) in the direction of a short side when the recording medium P is conveyed.

Figure 2:
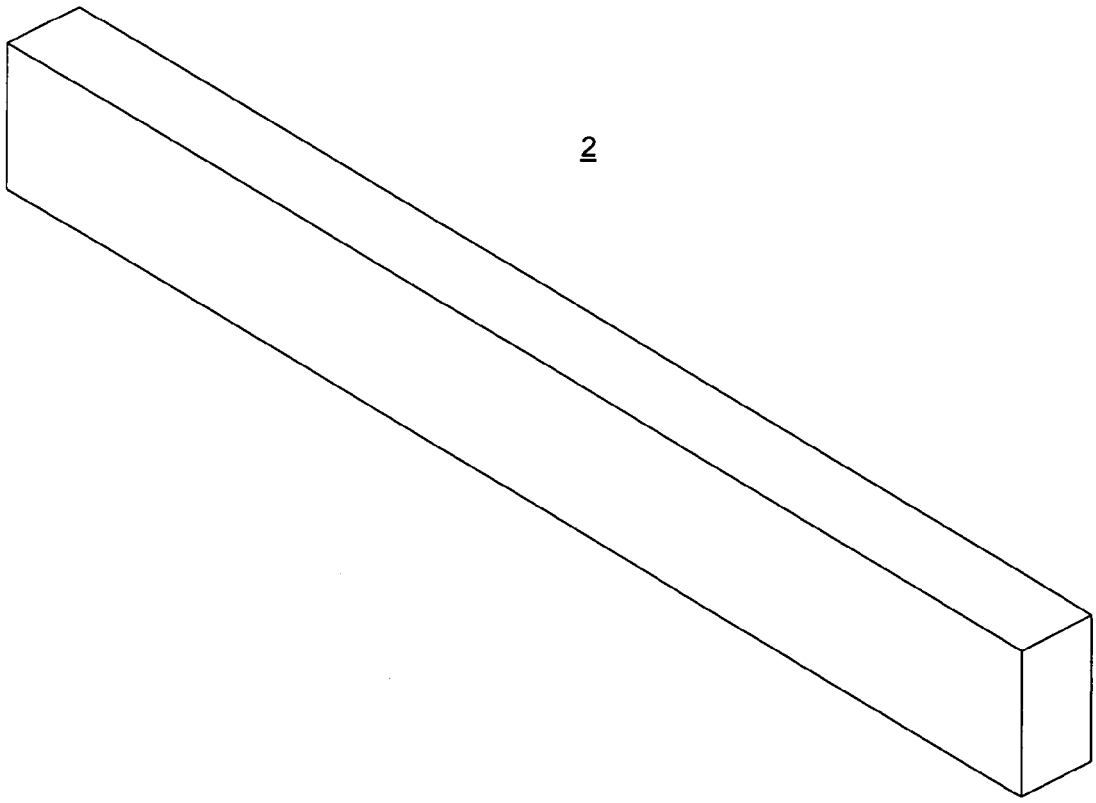
FIG. 2 is a schematic diagram of a print head.
Figure 3:
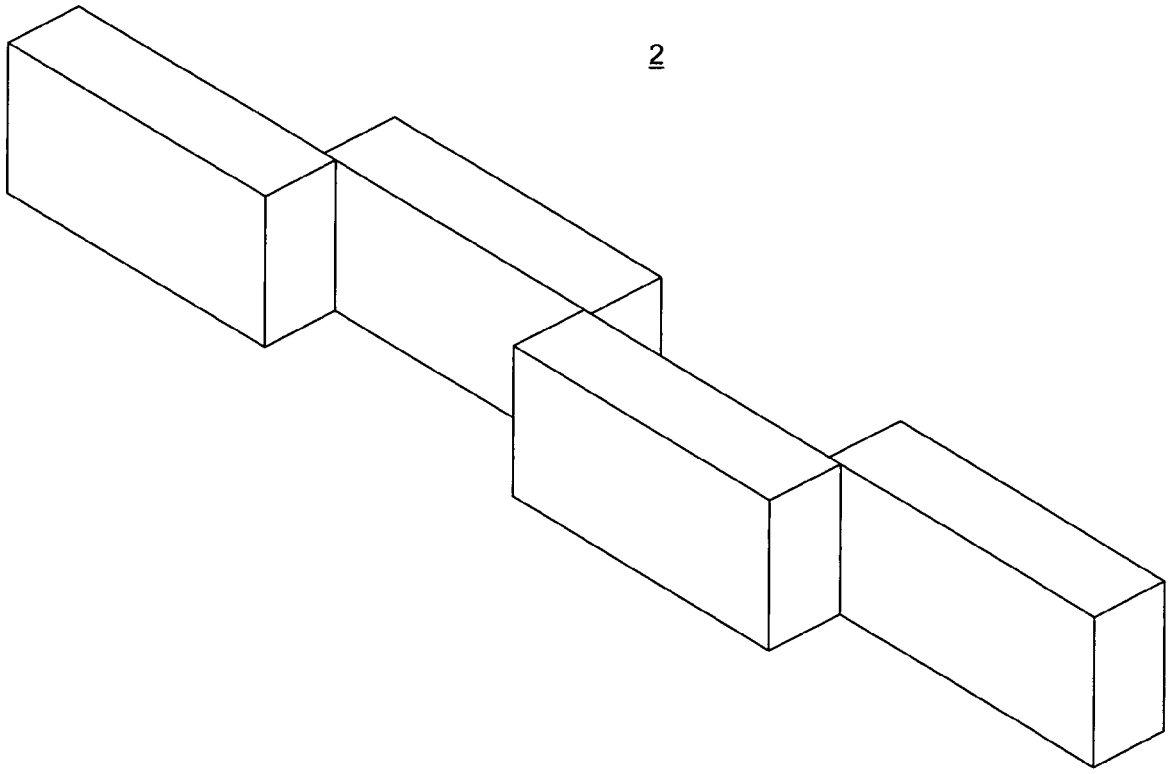
FIG. 3 is a schematic diagram of a print head.

Though the print head 2 may be organized as a single head as shown in FIG. 2, it may also be organized as a combination of plural units as shown in FIG. 3. When coping with a full-color print, the print head of this kind is provided for each of plural elementary colors such as Y, M, C and K. Though an explanation will be given as follows with an example wherein the print head 2 is single, the contents are the same even in the case of plural heads. The print head 2 is an example of the print head in the invention.

The print head 2 is driven by head driving section 4. The recording medium P is conveyed by medium conveying section 6. A supply of recording medium P to the print head 2 is also conducted by the medium conveying section 6. Head driving section 4 is an example of the head driving means in the invention. The medium conveying section 6 is an example of the medium conveying means of the invention.

Figure 4:
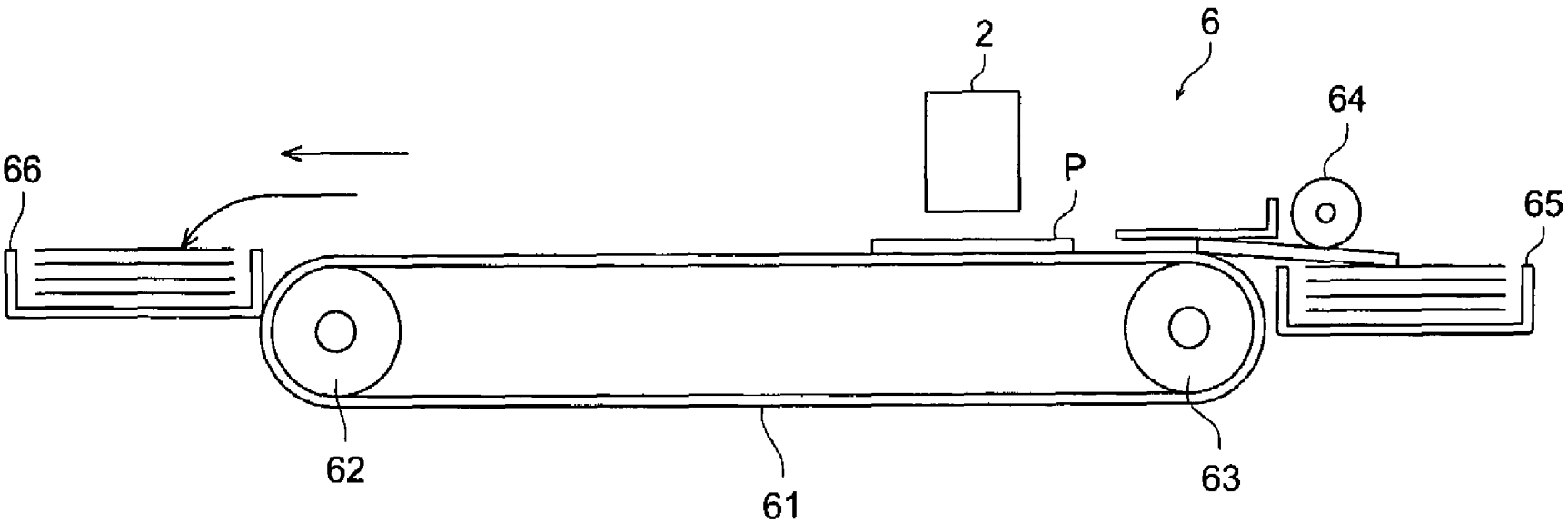
FIG. 4 is a schematic diagram of a medium conveying section.

As the medium conveying section 6, there is used one wherein conveying belt 61 is trained about a pair of pulleys 62 and 63, for example, as shown in FIG. 4. The paired pulleys 62 and 63 wherein one is a driving side and the other is a driven side rotate in the same direction to convey recording medium P placed on the belt 61 in the direction of an arrow. The belt 61 has, for example, air permeability, to be capable of absorbing and holding recording medium P by an unillustrated suction means.

Figure 5:
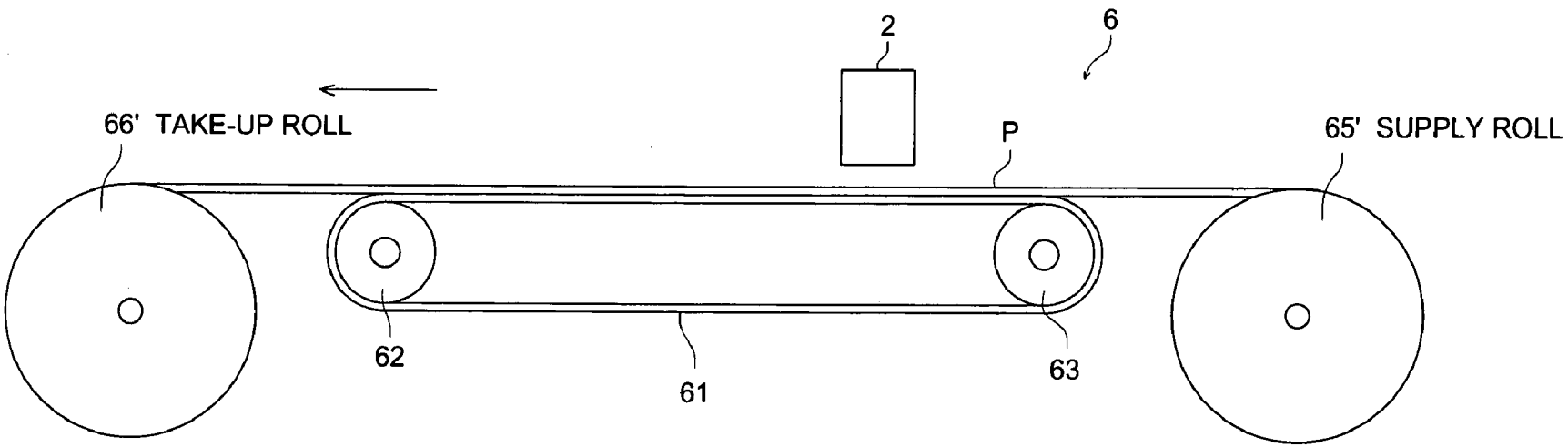
FIG. 5 is a schematic diagram of a medium conveying section.

The recording medium P is taken out of stacker 65 on the takeout side by sheet-feeding roller 64 to be supplied on belt 61. The recording medium P on which printing has been finished is ejected to stacker 66 on the receiving side. Incidentally, when the recording medium P is a continuous medium such as a roll sheet, the recording medium P is drawn out from supply roll 65' and is taken up by take up roll 66' after printing, as shown, for example, in FIG. 5.

In FIG. 1, driving of the print head 2 by head driving section 4 and conveyance of recording medium P by medium conveying section 6 are conducted under the control of control section 8. Conveyance synchronization signals detected by encoder 10 are inputted in the control section 8. As the encoder 10, a rotary encoder and a linear encoder, for example, are used. The conveyance synchronization signals are multiplied by PLL and others as occasion demands. The control section 8 controls the head driving section 4 based on the conveyance synchronization signals, and it makes ink jetting synchronized the conveyance to be conducted. The control section 8 is an example of a control means in the invention. The ink jetting control of this kind makes the driving frequency for the print head 2 to be one which is proportional to the conveyance speed for recording medium P. The driving frequency for the print head 2 is also called jetting frequency in this specification, from now on.

Temperatures on the head and ambient temperatures detected respectively by temperature sensor 12 and temperature sensor 14 are inputted respectively in the control section 8. The control section 8 utilizes also these temperature detection signals for print control.

Display section 16 and operation section 18 are connected to the control section 8. These are interfaces to be used by users. A user grasps the state of the present apparatus based on information displayed on display section 16, and inputs appropriate instructions through the operation section 18, and thereby to make the present apparatus to conduct desired print work. Establishment of the printing speed is also conducted through the operation section 18. The operation section 18 is an example of the speed setting means in the invention.

The control section 8 has document data memory 20 and control data memory 22. In the document data memory 20, there are stored data of document to be printed. These document data are read out by the control section 8, and contents thereof are printed on recording medium P as a hard copy. In the control data memory 22, there are stored data relating to print control. The control section 8 conducts print control by using these control data.

Print control by the control section 8 will be explained. An object of the print control is to enhance productivity, as much as possible, within a range of print quality permitted by the user. Since the productivity is proportional to the printing speed, the printing speed may be increased for enhancing productivity. However, an increase of the printing speed is followed by a decline of print quality, which needs a trade-off. Though the trade-off is determined by a user, to make delicate trade-off possible, it is desirable that the printing speed set by the user can be adjusted on an infinitely variable basis.

On the other hand, the speed zone which makes the printing to be unstable is sometimes caused by apparatus conditions of the ink jet printer, namely, by mechanical or electrical conditions of the recording medium conveyance system or the print head. Therefore, it is not appropriate that the speed established by a user is reflected in the conveyance speed for a recording medium as it is.

Therefore, to cope with that circumstances, the control section 8 conducts control for the conveyance speed and a print interval, control to avoid an unstable speed zone, control for timing of conveyance speed changes, and control based on a temperature of the print head. These will be explained in succession as follows.

(1) Control of Conveyance Speed and Control for Avoiding Unstable Speed Zone

From now on, the conveyance speed for the recording medium is simply called the conveyance speed, and the time interval from the end of printing for a certain page to the start of printing for the next page is simply called a time interval or a print interval.

Establishment of the printing speed is conducted through the operation section 18. The operation section 18 is organized to be capable of setting the printing speed on an infinite variable basis. A user can set optional printing speed through the operation section 18. The printing speed is established as the number of prints per unit time, for example, as the number of print pages per one minute.

Based on the printing speed thus established, the control section 8 obtains a combination of the conveyance speed for attaining the printing speed. In that case, the conveyance speed is obtained by excluding the speed zone wherein printing is made to be unstable by apparatus conditions.

However, in the conveyance speed and the jetting frequency, there exist an unstable speed area and an unstable jetting frequency area. Incidentally, the conveyance speed causing instability means a phenomenon wherein, for example, a vibration with a resonance frequency of the conveyance system grows greater, and thereby, a recording medium vibrates to disturb an impact position and to deteriorate print quality. Further, the jetting frequency causing instability means a phenomenon wherein, for example, ink is prevented from being jetted and an amount of jetted liquid is made to be unstable by interactions of acoustic vibrations generated in ink in the head and driving, and print quality is deteriorated.

With regard to a method to lower the printing speed with the maximum printing speed that serves as a starting point, the printing speed is lowered first, by lowering the conveyance speed (and a jetting frequency which is proportional to the conveyance speed) while keeping the print interval at the minimum value.

When the conveyance speed (and a jetting frequency which is proportional to the conveyance speed) enter the unstable area undesirably after they are lowered, they are not employed.

The printing speed is further lowered, and when it reaches the printing speed or less at which the conveyance speed (and a jetting frequency which is proportional to the conveyance speed) are lower than those in the unstable area even in the case of the minimum print interval, the print interval is made to be the minimum value again, and the conveyance speed (and a jetting frequency which is proportional to the conveyance speed) are lowered while keeping that print interval at the minimum value, and thereby, the printing speed is lowered.

An example including the conveyance speed and the time interval which have been determined is shown below. For example, apparatus conditions of the present apparatus are given as follows. These apparatus conditions are stored in control data memory 22 in advance.

Page length: 210 mm (shorter side of A4, A longer side is 297 mm.)

The number of dots in the page length direction: 4961 (600 dots/25.4 mm)

The maximum value of the conveyance speed: 1000 mm/sec

The minimum value of time interval: 0.1 sec

Maximum driving frequency of print head: 23.6 kHz

Driving frequency range causing printing unstable: 19.2-20.9 kHz (813-880 mm/sec. in conversion into conveyance speed)

Conveyance speed range causing printing unstable: 780-850 mm/sec.)

The maximum value of printing speed: 194 pages/min.

FIG. 6 shows the conveyance speed determined by control section 8 under the apparatus conditions mentioned above. As shown in FIG. 6, the conveyance speed is obtained as 1000 mm/sec. for the printing speed of 194 pages/min. established by a user. This is to realize the highest printing speed. For the printing speed 178-194 pages/min., the conveyance speed is obtained as 885→1000 mm/sec. Namely, the conveyance speed is changed corresponding to the change of established value for printing speed.

For the printing speed of 161 to 178 pages/min., the printing speed is regarded as non employment speed. Because due to the printing speed in this scope, the conveyance speed or driving frequency enters the scope in which printing becomes unstable.

For the printing speed 0 to 161 pages/min., the conveyance speed is obtained as 0 to 770 mm/sec. That is, the conveyance speed can be changed corresponding to the change of established value for printing speed. The conveyance speed in this case is out of the lower limit of the speed range that causes printing to be unstable. Namely, it is out of the lower limit of the conveyance speed corresponding to the driving frequency range that causes printing to be unstable, and is out of the lower limit of the conveyance speed range that causes printing to be unstable.

In the example shown in FIG. 6, the print interval is always fixed, however it is also possible to obtain the desired printing speed, by the combination of the print interval, which is set to be changeable, and the conveyance speed. Accordingly, the print interval can be fixed or changeable.

Under the control by the control section 8, the head driving section 4 drives print head 2 with driving signals having a waveform corresponding to the driving frequency. With regard to the waveform of the driving signal, optimum driving waveforms for various driving frequencies are determined in advance by changing, for example, voltage, a pulse width and slopes of a rise and a fall, and when the conveyance speed is changed, the driving frequency synchronized with the conveyance speed is estimated, and the optimum driving waveform corresponding to the estimated driving frequency is used for driving. Due to this, it is possible to conduct stable ink jetting for the total range of conveyance speed, and print quality turns out to be constant regardless of conveyance speed.

Incidentally, the printing speed may be established by a user as the conveyance speed or a combination of the conveyance speed and the time interval. This makes it possible to conduct detailed establishment of the printing speed. In that case, it is convenient that the conveyance speed range which causes printing to be unstable is displayed on display section 16 in advance, so that a user may establish the printing speed by avoiding that conveyance speed range. Or, it is also possible to indicate, as a guide line, the ranges which can be established, or to devise so that the conveyance speed range causing instability cannot be established.

Further, it is also possible to control so that, when there is a blank on the last part of the page, a blank on the last part of the page is detected by analyzing document data, and this part is conveyed at the speed that is higher than the conveyance speed for printing, to increase the printing speed.

(2) Control of Timing for Conveyance Speed Changes

A user may change the establishment of printing speed on the half way of printing, as occasion demands. Corresponding to these changes of establishment, the conveyance speed or a new combination of the conveyance speed and the time interval are obtained by the control section 8, and this new combination is applied to conveyance by selecting the timing. Namely, the change of the conveyance speed or the change of the conveyance speed caused by this new combination is made after the printing for one page is completed. Therefore, the conveyance under the new combination is conducted on the following page and thereafter. By doing this, it is possible to prevent that the conveyance speed is changed on the half way of printing on a page and a difference in level of image quality on a print is generated. Though the change of image quality may exist between pages, that change is inconspicuous because it is not one within the same page.

(3) Control of Conveyance Speed and Print Interval and Control for Avoiding Unstable Speed Zone Though the conveyance speed for a recording medium determines the printing speed for a document fundamentally, a time interval from the end of printing for one page to the start of printing for the next page is also related to the printing speed. Therefore, it is possible to make the practical printing speed to agree with the printing speed established by a user by controlling the aforesaid items. From now on, the conveyance speed for the recording medium is simply called the conveyance speed, and the time interval from the end of printing for a certain page to the start of printing for the next page is simply called a time interval or a print interval.

Establishment of the printing speed is conducted through the operation section 18. The operation section 18 is organized to be capable of setting the printing speed on an infinite variable basis. A user can set optional printing speed through the operation section 18. The printing speed is established as the number of prints per unit time, for example, as the number of print pages per one minute.

Based on the printing speed thus established, the control section 8 obtains a combination of the conveyance speed and the time interval which are for attaining the printing speed. In that case, the conveyance speed is obtained by excluding the speed zone wherein printing is made to be unstable by apparatus conditions. Then, the time interval is obtained so that the practical printing speed under that conveyance speed may agree with the printing speed established by the user.

With regard to quality declines in the case of a speedup of the printing speed, some of them can be improved by decreasing the printing speed with at least one of lowering the conveyance speed (and a jetting frequency which is proportional to the conveyance speed) and enlarging the print interval, and thereby, by lessening the number of print pages per unit time like "a quality decline caused by changes in physical properties of ink resulting from temperature rise on the print head" for example, depending on a cause of the quality decline, but others cannot be improved if the conveyance speed (and a jetting frequency which is proportional to the conveyance speed) are not decreased, even when the print interval is increased, like "a print quality decline caused by deterioration of graininess resulting from the background that if the frequency for driving the print head is raised, the dispersion of an amount of liquid-drop of ink to be jetted, an angle of fly and of a flying speed grows greater, which increases an error of an impact position of an ink drop, together with a speedup of the conveyance speed for a recording medium, and by occurrence of banding".

In view of the foregoing, when lessening the number of print pages per unit time for avoiding the decline of print quality, it is sometimes given priority that the conveyance speed (and a jetting frequency which is proportional to the conveyance speed) are decreased, while keeping the print interval at the minimum value.

However, in the conveyance speed and the jetting frequency, there exist an unstable speed area and an unstable jetting frequency area. Incidentally, the conveyance speed causing instability means a phenomenon wherein, for example, a vibration with a resonance frequency of the conveyance system grows greater, and thereby, a recording medium vibrates to disturb an impact position and to deteriorate print quality. Further, the jetting frequency causing instability means a phenomenon wherein, for example, ink is prevented from being jetted and an amount of jetted liquid is made to be unstable by interactions of acoustic vibrations generated in ink in the head and driving, and print quality is deteriorated.

Based on the foregoing, when the conveyance speed (and a jetting frequency which is proportional to the conveyance speed) turn out to be in an unstable speed range (or a range of jetting frequency) under the condition of the minimum value of the print interval, the conveyance speed (and a jetting frequency which is proportional to the conveyance speed) are fixed to the lowest value in the range that is higher than the unstable area, and the print interval is made to be larger.

With regard to a method to lower the printing speed with the maximum printing speed that serves as a starting point, the printing speed is lowered first, by lowering the conveyance speed (and a jetting frequency which is proportional to the conveyance speed) while keeping the print interval at the minimum value.

When the conveyance speed (and a jetting frequency which is proportional to the conveyance speed) enter the unstable area undesirably after they are lowered, the print interval is made to be greater while it is fixed to the lowest value in the range that is higher than the unstable area.

The printing speed is further lowered, and when it reaches the printing speed or less at which the conveyance speed (and a jetting frequency which is proportional to the conveyance speed) are lower than those in the unstable area even in the case of the minimum print interval, the print interval is made to be the minimum value again, and the conveyance speed (and a jetting frequency which is proportional to the conveyance speed) are lowered while keeping that print interval at the minimum value, and thereby, the printing speed is lowered.

An example including the conveyance speed and the time interval which have been determined is shown below. For example, apparatus conditions of the present apparatus are given as follows. These apparatus conditions are stored in control data memory 22 in advance.

Page length: 210 mm (shorter side of A4, A longer side is 297 mm.)

The number of dots in the page length direction: 4961 (600 dots/25.4 mm)

The maximum value of the conveyance speed: 1000 mm/sec.

The minimum value of time interval: 0.1 sec.

Maximum driving frequency of print head: 23.6 kHz

Driving frequency range causing printing unstable: 19.2-20.9 kHz (813-880 mm/sec. in conversion into conveyance speed)

Conveyance speed range causing printing unstable: 780-850 mm/sec.)

The maximum value of printing speed: 194 pages/min.

FIG. 7 shows a combination of the conveyance speed and time interval which are determined by control section 8 under the apparatus conditions mentioned above. AS shown in FIG. 7, the conveyance speed and the time interval are obtained respectively as 1000 mm/sec. and 0.1 sec. for the printing speed of 194 pages/min. established by a user. This is to realize the highest printing speed. For the printing speed 178-194 pages/min., the conveyance speed and the time interval are obtained respectively as 885→1000 mm/sec. and 0.1 sec. Namely, the conveyance speed is changed corresponding to the change of established value for printing speed while keeping the time interval at the minimum value.

For the printing speed 161 to 178 pages/min., the conveyance speed and the time interval are obtained respectively as 885 mm/sec. and 0.135 to 0.1 sec. Namely, an effective printing speed is achieved with changes of the time interval by making the conveyance speed constant regardless of changes in established value for the printing speed. The constant conveyance speed is out of the upper limit of the speed range that causes printing to be unstable. Namely, it is out of the upper limit of the conveyance speed corresponding to the driving frequency range that causes printing to be unstable, and is out of the conveyance speed range that causes printing to be unstable.

For the printing speed 161 pages/min., the conveyance speed and the time interval are obtained respectively as 770 mm/sec. and 0.1 sec. The conveyance speed in this case is out of the lower limit of the speed range that causes printing to be unstable. Namely, it is out of the lower limit of the conveyance speed corresponding to the driving frequency range that causes printing to be unstable, and is out of the lower limit of the conveyance speed range that causes printing to be unstable.

For the printing speed 0 to 161 pages/min., the conveyance speed and the time interval are obtained respectively as 0 to 770 mm/sec. and 0.1 sec. Namely, the conveyance speed is changed responding to changes of established values for printing speed, while the time interval is kept to the minimum value. This conveyance speed is out of the lower limit of the speed range that causes printing to be unstable. In other words, it is out of the lower limit of the conveyance speed corresponding to the driving frequency range causing printing unstable, and is out of the lower limit of the conveyance speed range causing printing unstable.

Figure 8:
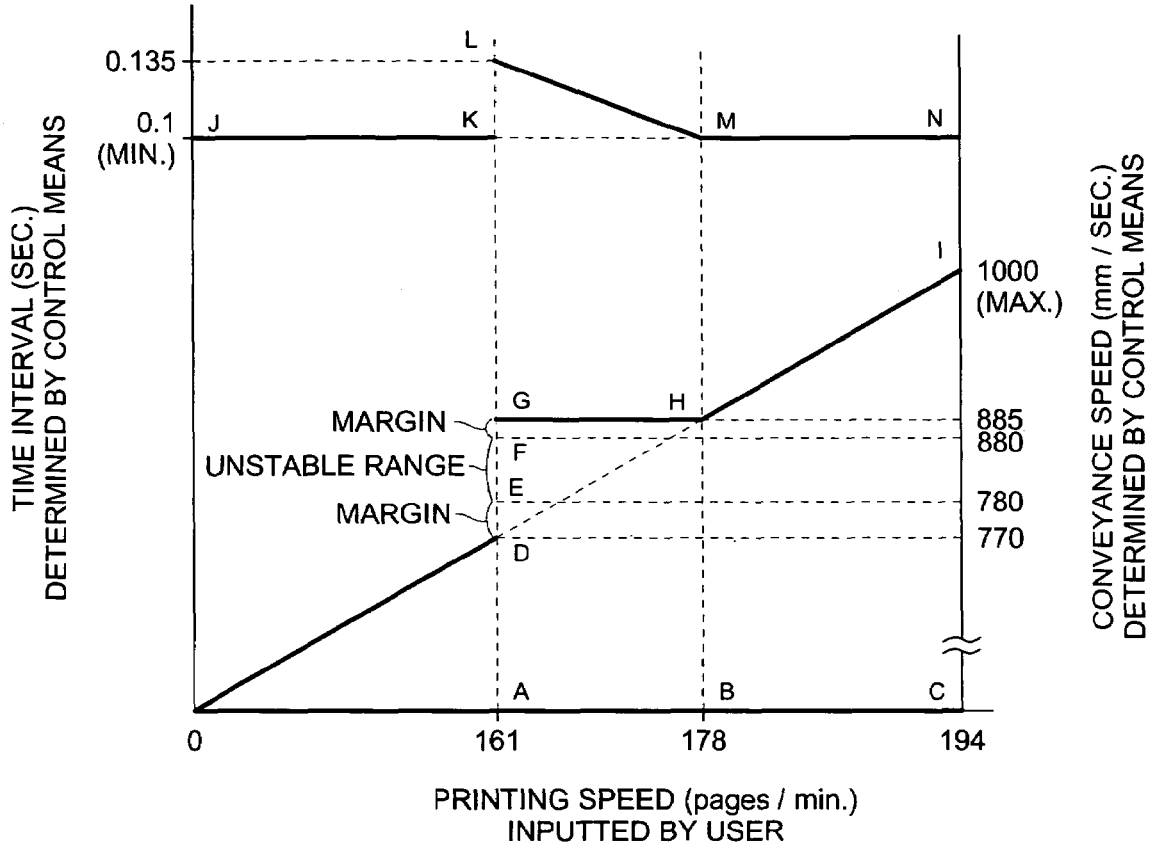
FIG. 8 is graphs showing the correspondence shown in FIG. 7.

FIG. 8 shows graphs of the above-mentioned correspondence of time interval (sec.), conveyance speed (mm/sec), and printing speed (pages/min.). The left coordinate axis shows the time interval, the right coordinate axis shows the conveyance speed, and the horizontal axis shows the printing speed, wherein when a user inputs the desired printing speed from the range of 0-194 pages/min., the control means determines the conveyance speed from the range of 0-D-G-H-I, as well as the time interval from the range of J-K-L-M-N.

The control section 8 causes the medium conveying section 6 to convey recording medium P with a combination of the conveyance speed and the time interval thus obtained, and causes the head driving section 4 to conduct ink jetting which is synchronized with the conveyance of the recording medium P. The foregoing makes it possible to conduct printing at the effective speed that agrees with what is established by a user, while avoiding the conveyance speed that causes printing to be unstable.

Under the control by the control section 8, the head driving section 4 drives print head 2 with driving signals having a waveform corresponding to the driving frequency. With regard to the waveform of the driving signal, optimum driving waveforms for various driving frequencies are determined in advance by changing, for example, voltage, a pulse width and slopes of a rise and a fall, and when the conveyance speed is changed, the driving frequency synchronized with the conveyance speed is estimated, and the optimum driving waveform corresponding to the estimated driving frequency is used for driving. Due to this, it is possible to conduct stable ink jetting for the total range of conveyance speed, and print quality turns out to be constant regardless of conveyance speed.

Incidentally, the printing speed may be established by a user as a combination of the conveyance speed and the time interval. This makes it possible to conduct detailed establishment of the printing speed. In that case, it is convenient that the conveyance speed range which causes printing to be unstable is displayed on display section 16 in advance, so that a user may establish the printing speed by avoiding that conveyance speed range. Or, it is also possible to indicate, as a guide line, the ranges which can be established, or to devise so that the conveyance speed range causing instability cannot be established.

Further, it is also possible to control so that, when there is a blank on the last part of the page, a blank on the last part of the page is detected by analyzing document data, and this part is conveyed at the speed that is higher than the conveyance speed for printing, to increase the printing speed.

(4) Control of Timing for Conveyance Speed Changes

A user may change the establishment of printing speed on the half way of printing, as occasion demands. Corresponding to these changes of establishment, a new combination of the conveyance speed and the time interval is obtained by the control section 8, and this new combination is applied to conveyance by selecting the timing. Namely, the change of the conveyance speed caused by this new combination is made after the printing for one page is completed. Therefore, the conveyance under the new combination is conducted on the following page and thereafter. By doing this, it is possible to prevent that the conveyance speed is changed on the half way of printing on a page and a difference in level of image quality on a print is generated. Though the change of image quality may exist between pages, that change is inconspicuous because it is not one within the same page.

(5) Control Based on Temperature of Print Head

Since print head 2 conduct ink jetting by using a piezo-element or an electric heat conversion element, temperatures rise with generation of heat caused by power consumption in the piezo-element or the electric heat conversion element, power consumption in electrical resistance of a wiring pattern and power consumption in driving IC provided on the head or provided in the vicinity of the head.

Since the generation of heat per unit time of the head is greater when the driving frequency is higher, under the condition of the same document, the temperature rise is greater when the printing speed is higher. If the printing speed is the same, the temperature rise is greater when the number of times of ink jetting on a page is more, and partial temperature rise takes place where an amount of ink jetting per a unit area is more. The temperature rise is influenced also by ambient temperature, because the temperature rise is a balance between generation of heat and radiation of heat.

If a temperature of print head 2 rises, an ink temperature in the head rises and physical properties of ink are changed, and when physical properties of ink are changed, an amount of liquid-drop and a flying speed of ink to be jetted, for example, are changed, and colors and density of a print are changed. In case of a high-speed printer wherein a large number of documents which are of the same kind, or are substantially the same except only a small different part are printed in many cases, it is not preferable that there are differences of color and density between prints.

If a temperature of print head 2 rises to exceed a tolerance, physical properties of ink are changed greatly, resulting in that ink jetting turns out to be unstable, a nozzle surface of print head 2 is contaminated with broken liquid-drops, or an air bubble enters the head to make it impossible for ink to be jetted. In such a case, ink is forced to be sucked up from a nozzle, or head cleaning to wipe the nozzle surface with a blade is conducted. Otherwise, there is caused a problem that ink cannot be jetted stably again.

Therefore, the control section 8 monitors head temperatures and ambient temperatures detected respectively by temperature sensors 12 and 14, and conducts control for preventing a decline of print quality and troubles requiring head cleaning. Concerning the head temperature, its absolute value and a speed of changes are monitored.

A change of temperature means a range of temperatures in a unit of ° C. for which the temperature was changed within a unit time such as, for example, one second, and when the temperature change exceeds a prescribed limit, it is estimated that an amount of liquid-drop of ink and a fly speed are changed, and colors and density of a print are changed accordingly. Therefore, warning to this effect is given to a user by means of display section 16, and when the temperature change is in the positive direction, an advice is given to the user to lower the establishment of the printing speed (or, to raise the establishment of the printing speed in the case of temperature change in the negative direction). In this case, it is also possible to provide a plurality of limits and thereby to give thunder words of advice or warning stepwise.

If a user lowers the establishment of the printing speed based on the advice or warning, changes in print quality can be prevented. When the changes in print quality are tolerated, the user can continue printing under the original setting in spite of the warning.

Further, it is also possible to provide an arrangement wherein, when the temperature change exceeds the prescribed limit, the establishment of printing speed is lowered automatically when the temperature change is in the positive direction, and the establishment of printing speed is raised automatically when the temperature change is in the negative direction. Owing to this, changes of print quality caused by carelessness of the user can be prevented.

When the control section 8 judges, from the head temperature and temperature changes of the head, that the head temperature is feared to exceed the prescribed limit, it causes the printing speed to be lowered automatically. In this case, it is also possible to provide an arrangement to notify a user of this lowering of the printing speed.

Further, when an absolute value of the head temperature exceeds the prescribed limit, and when an impossibility of stable ink jetting again is feared if a returning work such as head cleaning is not conducted, the control section 8 causes printing to be stopped automatically. By doing this, changes in quality of prints caused by a head temperature rise and serious troubles of the head can be prevented beforehand.

It is possible to estimate a head temperature rise based on the contents of a document. Namely, in the case of a document including many full color pages, it is possible to estimate that a temperature rise is great, because the total number of times of ink jetting for printing the document is large. In contrast to this, it is possible to estimate, for a document having only characters and many blanks, that a temperature rise is less, because the total number of times of ink jetting for printing the document is small. In other words, the total number of times of ink jetting can be utilized as a value of characteristics of a document for estimating the temperature rise.

Further, in the case of a document having several portions each requiring concentrated ink jetting, it is also possible to estimate that a head temperature rise is great, even when the total number of times of ink jetting is not necessarily large. In addition, insufficient fixing and insufficient drying can be estimated to be caused easily. The portion of this kind can be estimated from the maximum value of an amount of ink jetting per a unit area. Namely, the amount of ink jetting per a unit area can be used as a value of characteristics of the document for estimating a temperature rise and estimating print quality.

In this case, the control section 8 analyzes document data which are stored in document data memory 20 and are to be printed, and estimates, based on a value of the characteristics of the document, a head temperature rise and print quality in the case of printing at the standard printing speed. When the estimated temperature exceeds the prescribed limit, the control section 8 obtains the maximum value of the printing speed that can make the head temperature and print quality to be within a tolerance even under the value of the characteristics. The maximum value of the printing speed is obtained as a combination of the maximum value of the conveyance speed and the minimum value of the time interval. The maximum value of the printing speed of this kind is displayed on the display section 16.

Owing to this, a user can learn the upper limit of the printing speed that can be established in advance, which makes is possible to conduct printing speed setting within that range, accordingly. Or, it is also possible to arrange so that setting of the printing speed exceeding the upper limit is prohibited. The foregoing makes it possible to conduct printing that is free from quality decline caused by the head temperature rise.

Incidentally, it is also possible to enhance probability of estimation by using an existing value of the head temperature before the start of printing and an ambient temperature, for estimation of the head temperature. Further, since the speeds of fixing and drying vary depending on types of recording media such as plain paper, fine-quality paper and coated paper, it is preferable that information about types of recording media is also utilized for the printing speed limit based on estimation of head temperatures and on estimation of print quality.

Values of characteristics of a document, types of recording media, and relationship between head temperature as well as ambient temperature and a value of the upper limit of the printing speed are obtained by experiments and simulations in advance and are stored in control data memory 22 as control data tables. The control section 8 obtains a value of the upper limit of the printing speed by referring to these control data tables.

EFFECT OF THE INVENTION (1) In the invention described in Structure 1 or 11, the control means determines the conveyance speed for a recording medium under the print head and a time interval from the end of printing for one page to the start of printing for the next page, based on the print head speed set by the speed setting means, and it makes a medium conveying means to conduct conveyance and supply of the recording medium under the conditions of the aforesaid conveying speed and the time interval.

Namely, printing at the printing speed established by a user is broken down into the combination of the conveyance speed for a recording medium and the time interval from the end of printing for one page to the start of printing for the next page to be carried out. Accordingly, it is possible to realize an ink jet printer wherein the trade-off between the printing speed and the print quality is achieved under the condition of satisfactory productivity.

(2) In the invention described in Structure 2 or 12, the printing speed established by the speed setting means is made to be a combination of the conveyance speed and the time interval. Therefore, in addition to the foregoing, a user can set the optimum combination of the conveyance speed and the time interval.

(3) In the invention described in Structure 3 or 13, the printing speed established by the speed setting means is made to be an amount of prints per unit time. Therefore, in addition to the foregoing, a user can conduct printing under the optimum combination of the conveyance speed and the time interval, only by setting an amount of prints per unit time.

(4) In the invention described in Structure 4 or 14, the conveyance speed determined by the control means is made a speed excluding the speed determined in advance. Therefore, in addition to the foregoing, stable printing can be carried out.

(5) In the invention described in Structure 5 or 15, the speed determined in advance is made to be the speed corresponding to the frequency that cannot drive the print head stably. Therefore, in addition to the foregoing, a decline of print quality caused by unstable operations of the print head can be prevented.

(6) In the invention described in Structure 6 or 16, the speed determined in advance is made to be the speed that cannot convey a recording medium stably. Therefore, in addition to the foregoing, a decline of print quality caused by unstable conveyance can be prevented.

(7) In the invention described in Structure 7 or 17, the control means restricts the maximum value of the conveyance speed and the minimum value of the time interval based on characteristic values of a document to be printed, kinds of recording media, ambient temperatures, and at least one of the print head temperatures. Therefore, in addition to the foregoing, it is possible to prevent a decline of print quality caused by influences of load conditions for the print head, types of recording media, ambient temperatures and temperatures of the print head.

(8) In the invention described in Structure 8 or 18, the characteristic value is made to be the number of times of ink jetting required for printing of a document. Therefore, in addition to the foregoing, it is possible to prevent damage of the print head and a phenomenon of ink non-jetting that needs cleaning.

(9) In the invention described in Structure 9 or 19, the characteristic value is made to be the maximum value of an amount of jetted ink per a unit area necessary for printing of a document. Therefore, in addition to the foregoing, it is possible to prevent contamination caused by ink overflow on a recording medium.

(10) In the invention described in Structure 10 or 20, when the established speed is changed by the speed setting means in the course of printing, the control means applies new conveyance speed corresponding to the changed established speed to the next page and thereafter. Therefore, in addition to the foregoing, it is possible to keep the print quality within the same page to be constant.

(11) In the invention described in Structure 11, the control means monitors a temperature of the print head, and sends out a warning when the temperature change exceeds the limit determined in advance. Therefore, in addition to the foregoing, it is possible to send out a warning for a decline of print quality caused by changes in an amount of liquid drop resulting from temperature rise or by changes in a flying speed.

(12) In the invention described in Structure 12, the control means monitors a temperature of the print head, and stops printing when the temperature change exceeds the limit determined in advance. Therefore, in addition to the foregoing, it is possible to prevent damage of the head caused by temperature rise and a phenomenon of ink non-jetting that needs cleaning.

(13) In the invention described in Structure 13 or 23, the print head 2 means drives the print head with driving signals having a waveform corresponding to the conveyance speed. Therefore, in addition to the foregoing, it is possible to drive the print head optimally regardless of changes in driving frequency corresponding to the conveyance speed.

(14) In the invention described in Structure 14 or 24, the printing speeds which can be established by the speed setting means are infinitely variable. Therefore, in addition to the foregoing, it is possible to adjust continuously the trade-off between the printing speed and print quality.

What is claimed is:

1. An ink jet printer, comprising:

a print head having plural nozzles for jetting ink over a length corresponding to a dimension of a recording medium that is perpendicular to a conveyance direction of the recording medium;

a recording medium conveying section that supplies the recording medium to the print head and conveys the recording medium under the print head;

a print head driving section that drives the print head to jet ink in synchronization with conveyance of the recording medium;

a speed setting section to set a printing speed based on an instruction of a user; and a control section, which determines: (i) a conveyance speed of the recording medium under the print head based on the printing speed established by the speed setting section, and (ii) a time interval from completion of printing of one page to a start of printing of a next page, and which controls the recording medium conveying section to convey and supply the recording medium at the determined conveyance speed and the determined time interval.

2. The ink jet printer of claim 1, wherein the printing speed established by the speed setting section is a combination of the conveyance speed and the time interval.

3. The ink jet printer of claim 1, wherein the printing speed established by the speed setting section represents an amount of prints per unit time.

4. The ink jet printer of claim 1, wherein the conveyance speed to be determined by the control section excludes a predetermined speed range of the conveyance speed.

5. The ink jet printer of claim 4, wherein the predetermined speed range corresponds to a frequency range of jetting frequencies at which the print head cannot be driven stably.

6. The ink jet printer of claim 4, wherein the predetermined speed range is a range of speeds at which the recording medium cannot be conveyed stably.

7. The ink jet printer of claim 1, wherein the control section restricts a maximum value of the conveyance speed and a minimum value of the time interval based on at least one of: a characteristic value of a document to be printed, a type of the recording medium, an ambient temperature, and a temperature of the print head, and, the control section at least one of indicates and restricts a maximum value of the printing speed that can be set by the user.

8. The ink jet printer of claim 7, wherein the characteristic value of the document is a number of times of ink jetting required for printing of the document.

9. The ink jet printer of claim 7, wherein the characteristic value of the document is a maximum value of an amount of ink jetting per unit area required for printing of the document.

10. The ink jet printer of claim 1, wherein when the printing speed established by the speed setting section is changed in the course of printing, a new conveyance speed corresponding to the changed printing speed is applied to subsequent pages to be printed.

11. The ink jet printer of claim 1, wherein the control section monitors a temperature of the print head, and issues a warning when a temperature change of the print head exceeds a limit determined in advance.

12. The ink jet printer of claim 1, wherein the control section monitors a temperature of the print head, and stops printing when the temperature exceeds a limit determined in advance.

13. The ink jet printer of claim 1, wherein the head driving section drives the print head with driving signals having a wave form corresponding to the conveyance speed.

14. The ink jet printer of claim 1, wherein printing speeds which can be established by the speed setting section are infinitely variable.

15. An ink jet printer, comprising:

a print head having plural nozzles for jetting ink over a length corresponding to a dimension of a recording medium that is perpendicular to a conveyance direction of the recording medium;

a recording medium conveying section that supplies the recording medium to the print head and conveys the recording medium under the print head;

a print head driving section that drives the print head to jet ink in synchronization with conveyance of the recording medium;

a speed setting section to set a stepless printing speed based on an instruction of a user; and a control section, which determines a conveyance speed of the recording medium under the print head based on the printing speed established by the speed setting section, such that the determined conveyance speed is not in a predetermined speed range, and which controls the recording medium conveying section to convey the recording medium at the determined conveyance speed.

16. The ink jet printer of claim 15, wherein the predetermined speed range corresponds to a range of jetting frequencies at which the print head cannot be driven stably.

17. The ink jet printer of claim 15, wherein the predetermined speed range is a range of speeds at which the recording medium cannot be conveyed stably.

18. The ink jet printer of claim 15, wherein the control section restricts a maximum value of the conveyance speed based on at least one of: a characteristic value of a document to be printed, a type of the recording medium, an ambient temperature, and a temperature of the print head, and the control section at least one of indicates and restricts a maximum value of the printing speed that can be set by the user.

19. The ink jet printer of claim 18, wherein the characteristic value of the document is a number of times of ink jetting required for printing of the document.

20. The ink jet printer of claim 18, wherein the characteristic value of the document is a maximum value of an amount of ink jetting per unit area required for printing of the document.

21. The ink jet printer of claim 15, wherein, when the printing speed established by the speed setting section is changed in the course of printing, a new conveyance speed corresponding to the changed printing speed is applied to subsequent pages to be printed.

22. The ink jet printer according of claim 15, wherein the control section monitors a temperature of the print head, and issues a warning when a temperature change of the print head exceeds a limit determined in advance.

23. The ink jet printer of claim 15, wherein the control section monitors a temperature of the print head, and stops printing when the temperature exceeds a limit determined in advance.

24. The ink jet printer of claim 15, wherein the head driving section drives the print head with driving signals having a wave form corresponding to the conveyance speed.

25. An inkjet printer, comprising:

a print head having plural nozzles for jetting ink over a length corresponding to a dimension of a recording medium that is perpendicular to a conveyance direction of the recording medium;

a recording medium conveying section that supplies the recording medium to the print head and conveys the recording medium under the print head;

a print head driving section that drives the print head to jet ink in synchronization with conveyance of the recording medium;

a speed setting section to set a stepless printing speed based on an instruction of a user; and a control section which determines, based on the printing speed established by the speed setting section, a conveyance speed of the recording medium under the print head such that the determined conveyance speed is not in a predetermined speed range and a time interval from completion of printing of one page to a start of printing of a next page, and which controls the recording medium conveying section to convey the recording medium at the determined conveyance speed and the determined time interval.

* * * * *